US006619260B2

(12) United States Patent
Lehner et al.

(10) Patent No.: US 6,619,260 B2
(45) Date of Patent: Sep. 16, 2003

(54) METHOD FOR CORRECTING THE INPUT SIGNAL AND FOR SYNCHRONIZING THE CYLINDERS IN AN INTERNAL COMBUSTION ENGINE

(75) Inventors: Michael Lehner, Muehlacker (DE); Andrea Lohmann, Stuttgart (DE); Stephan Uhl, Friedrichshafen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/936,417

(22) PCT Filed: Jan. 4, 2001

(86) PCT No.: PCT/DE01/00011

§ 371 (c)(1),
(2), (4) Date: Oct. 9, 2001

(87) PCT Pub. No.: WO01/51793

PCT Pub. Date: Jul. 19, 2001

(65) Prior Publication Data

US 2002/0157642 A1 Oct. 31, 2002

(30) Foreign Application Priority Data

Jan. 12, 2000 (DE) ..... 100 00 871

(51) Int. Cl.[7] ..... F02P 5/15

(52) U.S. Cl. ..... 123/406.13; 123/406.14; 123/406.24

(58) Field of Search ..... 123/406.13, 406.14, 123/406.19, 406.2, 406.23, 406.26, 406.27

(56) References Cited

U.S. PATENT DOCUMENTS

| | | | | |
|---|---|---|---|---|
| 5,287,282 A | | 2/1994 | Imai | |
| 5,337,716 A | * | 8/1994 | Fukui et al. | 123/406.14 |
| 5,345,911 A | | 9/1994 | Kadowaki et al. | |
| 5,426,587 A | * | 6/1995 | Imai et al. | 701/111 |
| 5,822,710 A | * | 10/1998 | Mezger et al. | 701/110 |
| 5,862,505 A | * | 1/1999 | Fujiki | 701/111 |
| 6,155,105 A | * | 12/2000 | Klenk et al. | 73/117.3 |
| 6,209,519 B1 | * | 4/2001 | Melchior et al. | 123/406.24 |
| 6,439,198 B2 | * | 8/2002 | Lehner et al. | 123/436 |
| 6,457,455 B2 | * | 10/2002 | Baeuerle et al. | 123/406.24 |

FOREIGN PATENT DOCUMENTS

DE 198 28 279 12/1999

* cited by examiner

*Primary Examiner*—Hieu T. Vo
*Assistant Examiner*—Hai H. Huynh
(74) *Attorney, Agent, or Firm*—Walter Ottesen

(57) ABSTRACT

The method serves for input signal correction of a misfire detection function and for cylinder equalization in an internal combustion engine, especially of a motor vehicle. Here, it is provided that a control for the input signal correction (10) and a control of the cylinder equalization (11) are activated alternatively by an alternative circuit unit (12).

8 Claims, 1 Drawing Sheet

METHOD FOR CORRECTING THE INPUT SIGNAL AND FOR SYNCHRONIZING THE CYLINDERS IN AN INTERNAL COMBUSTION ENGINE

FIELD OF THE INVENTION

The invention relates to a method for the input signal correction of a misfire detection function and for the cylinder equalization in an internal combustion engine, especially of a motor vehicle.

BACKGROUND OF THE INVENTION

Methods for detecting combustion misfires by means of determining a rough running are known, if required, while considering filtered rough-running values. Likewise, methods for improving the quality of the combustion misfire detection, for example, by means of transducer wheel adaptations or general adaptations, belong to the state of the art. An optimization of the combustion misfire detection of this kind is known under the designation "fuel-on-adaptation". The fuel-on-adaptation is based on rough-running values or segment times of the internal combustion engine and learns transducer wheel faults and torque differences between the individual cylinders during operation of the engine. When learning the transducer wheel faults and the torque differences, corrective values are formed by the fuel-on-adaptation with which the instantaneously present segment times or the rough-running values, are corrected. Here, only the input signals of a misfire detection function are changed. A correction utilizing the fuel-on-adaptation has no effect on the engine as can take place, for example, in the form of a torque correction via an injected quantity of fuel increased in a suitable manner.

In gasoline direct injection systems, a cylinder equalization functions to cancel torque differences of individual cylinders during the operation of the engine. Torque differences of this kind amongst the individual cylinders can, for example, occur because of scattered differences of individual injection valves, which are present (manufacturing inaccuracies which cannot be avoided) or these torque differences can occur because of valve coking. A control for cylinder equalization determines the torque deviations amongst the individual cylinders on the basis of rough-running values during the operation of the engine. The cylinder torques are preferably equalized in a stratified operation by adapting the cylinder-individual injection quantity of fuel in the form of a dynamic control. The cylinder equalization functions to correct for cylinder-individual correction of the injection times in dependence upon the cylinder torques which are adjusted in each case. The corrected injection times have, in turn, an influence on the cylinder torque. Accordingly, an effect of the injection times on the cylinder torque is present so that torque differences amongst the cylinders can be controllable to the value zero via the control for cylinder equalization.

It is disadvantageous that a trouble-free function of the fuel-on-adaptation and therefore a reliable misfire detection during operation of the engine is not ensured.

SUMMARY OF THE INVENTION

The method of the invention is characterized in that a control for input signal correction and a control for cylinder equalization are alternatively activated. In this way, it is ensured that the activated control for input signal correction (fuel-on-adaptation) is not negatively influenced by the simultaneous activation of the control for cylinder equalization. Such a disturbance of the control for fuel-on-adaptation is especially caused by the situation that a correction of the input signals of misfire detection functions takes place also on the basis of the cylinder torques which, in turn, are corrected by means of the cylinder equalization. The cylinder equalization thereby influences the fuel-on-adaptation via the cancellation of torque differences between individual cylinders by means of cylinder-individual correction of the injection times. This is so, because the fuel-on-adaptation corrects the input signals of misfire detection functions, inter alia, on the basis of the cylinder torques. A reliable misfire detection and simultaneously an effective cylinder equalization is ensured during operation of the engine because of the alternative activation of the control for input signal correction and the control for cylinder equalization. This is so because the control for fuel-on-adaptation can only be activated at a time point at which the control for the cylinder equalization is not activated and vice versa.

A cylinder torque correction takes place for cylinder equalization and is advantageously considered by the activated input signal correction control. A detection and consideration of a cylinder torque correction is ensured in a reliable manner for an activated input signal control because of the alternative activation of the two controls. The cylinder torque correction was initiated by the previously activated cylinder equalization control for cylinder equalization.

According to a first embodiment, the cylinder torque correction values of the input signal correction control are incorporated in corresponding input signal correction values. In this way, and by means of a direct and time-proximate computation of the cylinder torque correction values with the input signal correction valves, a continuously adapted input signal correction is maintained during the activation of the corresponding control.

According to a second embodiment, the particular cylinder torque correction value is maintained constant when the input signal correction control is activated until the difference between a pregiven desired value and an actual value of the cylinder torque correction exceeds a fixable threshold value whereupon a new constant actual value is adjusted to the pregiven desired value and the input signal correction control is reset. Here, the cylinder torque value of the particular poorest cylinder is applied for the actual value. The desired value is adjusted as a new constant actual value for all cylinders. The input signal correction control (fuel-on-adaptation) is reset to neutral start values because of the reset thereof. In this way, the fuel-on-adaptation starts the learning proceeding from neutral start values. After the reset of the fuel-on-adaptation, the thresholds of a misfire detection are increased and are only lowered again after advanced fuel-on-adaptation.

In an advantageous manner, the cylinder equalization control adjusts the injection time at least for the next combustion for each cylinder in dependence upon the cylinder torque, which adjusts after each combustion. In this way, a reliable and effective cylinder equalization is ensured during the operation of the engine.

It is advantageous that the input correction forms corrective values for adjusting the input signals of at least one misfire detection function for each cylinder individually in dependence upon the degree of rough running and/or the segment times. In this way, the quality of the combustion misfire detection is improved or optimized in a reliable manner.

Preferably, the activation of the input signal correction control and the cylinder equalization control takes place via an alternative switching unit. Alternative switching units permit an alternative activation of the control for the input signal correction and the control for cylinder equalization in a reliable, rapid and automatic manner.

Additional advantageous configurations of the invention become evident from the description.

BRIEF DESCRIPTION OF THE DRAWINGS

The invention will be explained in greater detail in the following in an embodiment with respect to a corresponding drawing.

DESCRIPTION OF THE PREFERRED EMBODIMENTS OF THE INVENTION

Figure 1:
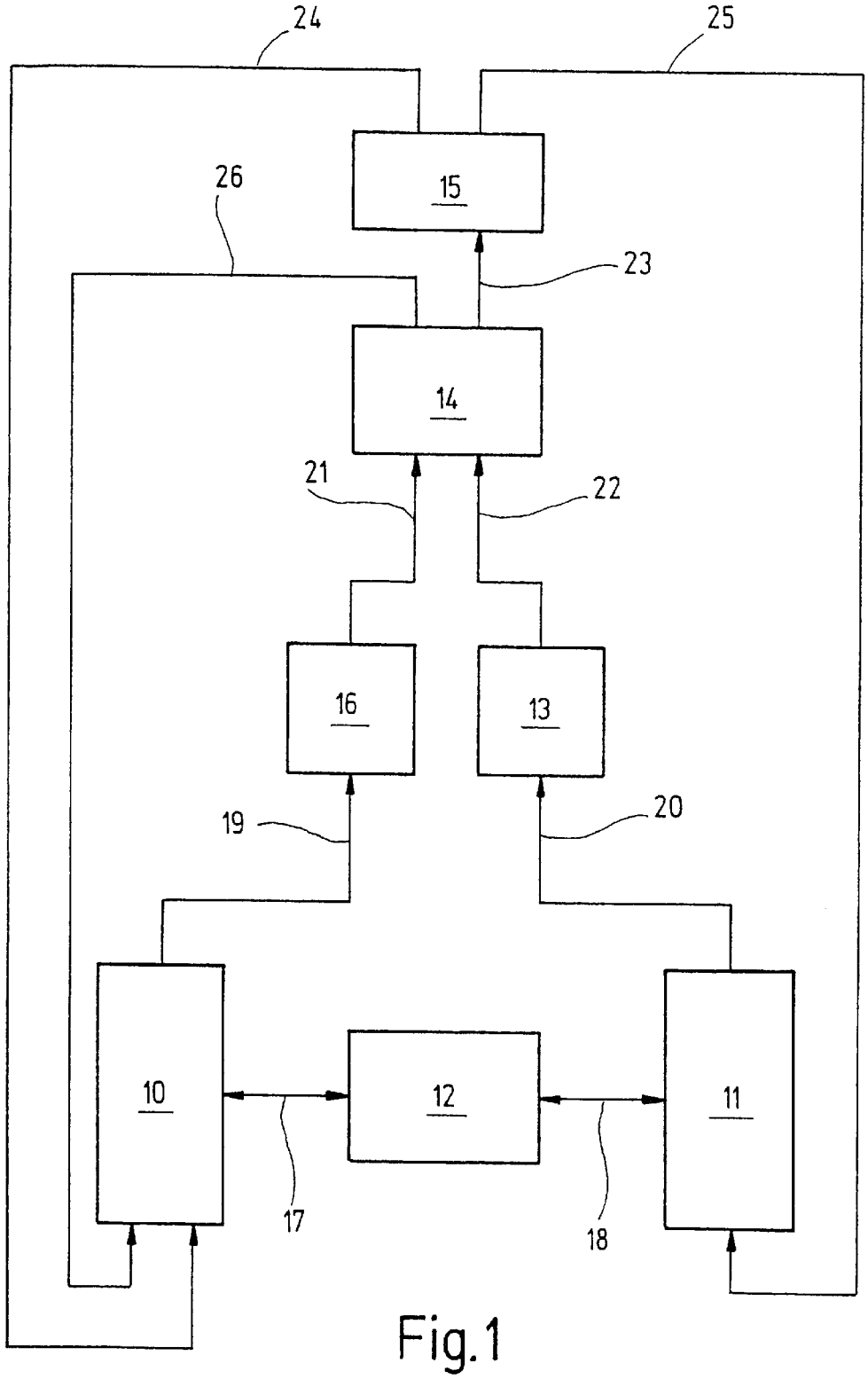
FIG. 1 is the only figure and shows a block circuit diagram for misfire detection and for cylinder equalization on a cylinder of an internal combustion engine.

With respect to FIG. 1, an input signal correction control 10 and a cylinder equalization control 11 are shown which are operatively connected to a cylinder 14 of an internal combustion engine (not shown). An alternative switching unit 12 is operatively connected to the input signal correction control 10 and the cylinder equalization control 11 via corresponding control lines shown as double arrows (17, 18) in such a manner that either the control 10 or the control 11 can be activated but not both the controls (10, 11) simultaneously.

The cylinder equalization control 11 is operatively connected to an injection time control unit 13 by means of a control line shown as arrow 20. The injection time control unit 13, in turn, can adjust the injection time at least for the next combustion in the cylinder 14 via a control line shown as arrow 22 or can adapt the injection time to the particular operating situation of the engine. A data transmission line is shown as arrow 23 and leads from cylinder 14 to a torque detecting unit 15, which is connected to the cylinder equalization control 11 via the data transmission line illustrated as arrow 25. The injection control unit 13, the cylinder 14, and the torque detecting unit 15 are thereby operatively connected to the cylinder equalization control as a closed control loop by means of the lines 20, 22, 23 and 25.

The input signal correction control 10 is also characterized as "fuel-on-adaptation" and is connected to a misfire detection function unit 16 via a data transmission line shown as arrow 19. The misfire detection function unit 16 is, in turn, in operative effective contact with the cylinder 14 via a connection shown as arrow 21. A data transmission line shown as arrow 24 leads from the torque detecting unit 15 to the input signal correction control 10 and a data transmission line shown by arrow 26 leads from the cylinder 14 to the input signal correction control 10.

In FIG. 1, only a single cylinder 14 of the engine is schematically shown for reasons of clarity. The internal combustion engine (not shown) however normally includes a plurality of cylinders which are in operative effective contact with the input signal correction control 10 and the cylinder equalization control 11 in accordance with FIG. 1. The schematic representation corresponding to FIG. 1 can therefore be transferred to all additional cylinders of an engine (not shown).

The control of the input signal correction 10 and the control of the cylinder equalization 11 are alternatively activated because of the alternative circuit unit 12. After a combustion, the cylinder equalization 11 adjusts the injection time at least for the following combustion in cylinder 14 by means of the injection time control unit 13 in dependence upon the particular cylinder torque which adjusts. For each cylinder individually, the input signal correction control 10 forms corrective values for adjusting the input signals for the misfire detection function unit 16 in dependence upon the degree of rough running and/or in dependence upon the segment time. Corresponding data are transmitted to the input signal correction control 10 via the data transmission lines in accordance with arrows 24, 26. Data with respect to the cylinder torque or its changes are transmitted to the input signal correction control 10 as well as to the cylinder equalization control 11 via data transmission lines in accordance with arrows 24, 25. The cylinder torque adjusts in each case after a combustion in cylinder 14. The cylinder equalization control 11 corrects the cylinder-individual injection times on the basis of the cylinder torques. These injection times, in turn, exercise influence on the cylinder torques of the respective subsequent combustions. Because of the control loop, the cylinder equalization control 11 is suitable to control to the value zero possibly occurring torque differences between the individual cylinders of the engine. The input signal correction control 10 also considers the respective values of the cylinder torques which are transmitted thereto by the torque detection unit 15 via the data transmission line shown as arrow 24. Additionally or as alternative, the segment times for forming the input signal corrective values can be considered.

It is possible that a cylinder torque correction, which adjusts for cylinder equalization, is considered by the active input signal correction control 10 in a reliable manner because of the operative inclusion of the alternative circuit unit 12 for alternatively activating the two controls 10, 11. The cylinder torque corrective values can be computed directly into corresponding input signal corrective values by the input signal correction control 19 if the control 10 is activated. In accordance with an alternative embodiment, the particular cylinder torque corrective value can also be held constant for an activated input signal correction control 10 until the difference between a pregiven desired value and an actual value of the cylinder torque correction exceeds a fixable threshold value whereupon a new constant actual value is adjusted to the pregiven desired value and the input signal correction control 10 is reset.

The input signal correction control 10 and the cylinder equalization control 11 are known per se with respect to their functional and constructive configuration and are therefore not described here in greater detail.

What is claimed is:

1. A method for input signal correction of a misfire detection function and for cylinder equalization in an internal combustion engine including an engine of a vehicle, the method comprising the step of alternatively activating a control for the input signal correction and a control for the cylinder equalization.

2. The method of claim 1, wherein a cylinder torque correction, which adjusts for cylinder equalization, is considered by the activated input signal correction control.

3. The method of claim 1, wherein the cylinder torque corrective values are computed into corresponding input signal corrective values by the input signal correction control.

4. The method of claim 1, wherein the particular cylinder torque corrective value for activated input signal correction control is held constant until the difference between a pregiven desired value and an actual value of the cylinder torque correction exceeds a fixable threshold value whereupon a new constant actual value is adjusted to the pregiven desired value and the input signal correction control is reset.

5. The method of claim 1, wherein the cylinder equalization control adjusts the injection time at least for the next combustion in dependence upon the corresponding cylinder torque which adjusts after a combustion.

6. The method of claim 1, wherein the input correction forms corrective values for adjusting input signals of at least a misfire detection function for each cylinder individually in dependence upon the degree of rough running and/or in dependence upon the segment time.

7. The method of claim 1, wherein the activation of the input signal correction control and the cylinder equalization control takes place by means of an alternative circuit unit.

8. A method for input signal correction of a misfire detection function and for cylinder equalization in an internal combustion engine including an engine of a vehicle, the method comprising the step of alternatively activating a control for the input signal correction and a control for the cylinder equalization so as to cause the control for the input signal correction to be only activated at a time at which the control for the cylinder equalization is not activated and vice versa.

* * * * *